US005950701A

United States Patent [19]

Rogers

[11] Patent Number: 5,950,701

[45] Date of Patent: Sep. 14, 1999

[54] DRIVE GEAR UNIT FOR VERTICAL BLIND SYSTEMS

[75] Inventor: Paul Rogers, Welgemoed, South Africa

[73] Assignee: Exactocraft (Proprietary) Limited, Paarden Eiland, South Africa

[21] Appl. No.: 09/106,356

[22] Filed: Jun. 29, 1998

[30] Foreign Application Priority Data

Jun. 30, 1997 [ZA] South Africa ..... 97/5797

[51] Int. Cl.[6] ..... E06B 9/38

[52] U.S. Cl. ..... 160/177 V; 160/900

[58] Field of Search ..... 160/177 V, 176.1 V, 160/168.1 V, 900, 177 R, 176.1 R

[56] References Cited

U.S. PATENT DOCUMENTS

| | | | |
|---|---|---|---|
| 3,134,428 | 5/1964 | Kehrer et al. . | |
| 3,269,453 | 8/1966 | Vecchiarelli . | |
| 3,343,588 | 9/1967 | Cayton . | |
| 3,463,219 | 8/1969 | Osterholz . | |
| 3,605,852 | 9/1971 | Vecchiarelli . | |
| 4,316,493 | 2/1982 | Arena . | |
| 4,552,195 | 11/1985 | Dürig . | |
| 4,559,670 | 12/1985 | Wyatt . | |
| 4,688,618 | 8/1987 | Saicheck, Jr. . | |
| 4,964,191 | 10/1990 | Wyatt . | |
| 5,054,535 | 10/1991 | Rozon | 160/176.1 V |
| 5,067,544 | 11/1991 | Spohr . | |
| 5,547,007 | 8/1996 | Grutzner . | |
| 5,577,542 | 11/1996 | Hung | 160/177 V |
| 5,630,457 | 5/1997 | Chou . | |
| 5,636,678 | 6/1997 | Carper . | |
| 5,647,422 | 7/1997 | Weng | 160/176.1 V |
| 5,749,406 | 5/1998 | Benthin | 160/177 V X |
| 5,845,695 | 12/1998 | Cadorette et al. | 160/168.1 V X |

*Primary Examiner*—David M. Purol
*Attorney, Agent, or Firm*—Larson & Taylor

[57] ABSTRACT

A drive gear unit is provided for tilting vertically orientated slats of a vertical blind system. The unit includes a frame and a connection element for connecting the frame to a tubular support rail for a vertical blind system. The unit further includes a wand drive member having a shaft and a first spur gear wheel provided on the shaft so that the shaft for operative connection to a wand, the first spur gear having teeth which extend radially outwardly from a central hub. A rod locating member is associated with the frame and has a passage for locatingly receiving the vertical blind drive rod. A rod drive member has a rod connecting part adapted to be operatively joined to the vertical blind drive rod, and further has a second spur gear wheel joined to the rod connecting part. The second spur gear wheel has teeth which extend radially outwardly from a central hub. The first spur gear wheel and the second spur gear wheel are in operative mesh.

11 Claims, 5 Drawing Sheets

DRIVE GEAR UNIT FOR VERTICAL BLIND SYSTEMS

BACKGROUND OF INVENTION

1. Field of Invention

The present invention relates to a drive gear unit for vertical blind systems.

More particularly, the invention relates to a drive gear unit for tilting vanes or slats of a vertical blind system for regulating inflow of sun rays and/or light into a room or other chamber.

2. Description of Related Prior Art

Various types of drive gear units for vertical blind systems are known.

Some of these systems are complicated and do not operate effectively.

Basically two types of drive gear units are known: The one type involves a worm gear drive, and the other a bevel gear drive.

Worm gear drives for vertical blind systems are for example disclosed in U.S. Pat. No. 5,630,457 (Chou), U.S. Pat. No. 3,134,428 (Kehrer et al), U.S. Pat. No. 3,343,588 (Cayton), U.S. Pat. No. 3,605,852 (Vecchlarelli et al).

Bevel gear drives for vertical blind systems are for example described in U.S. Pat. No. 4,316,493 (Arena), U.S. Pat. No. 5,547,007 (Grutzner), U.S. Pat. No. 3,269,453 (Vecchiarelli et al).

The bevel or mitre gear arrangements or the worm gear drives have to be very accurately produced to operate efficiently and therefore the tooling and production costs are expensive. Furthermore the assembly time is time consuming and costly.

It therefore is a primary object of the invention to suggest a drive gear unit for vertical blind systems, which will provide an improvement to known systems.

In accordance with the invention, a drive gear unit for tilting vertically orientated slats of a vertical blind system, includes a) a frame;

b) connection means for connecting the frame to a tubular support rail for a vertical blind system including a vertical blind drive rod and rotatable, vertically orientated slats;

c) a wand drive member having a shaft and a first spur gear wheel provided on the shaft and being rotatably mounted on the frame so that the shaft has an end extending out of the frame for operative connection to a wand and the first spur gear wheel being located inside the frame, the first spur gear having teeth which extend radially outwardly from a central hub;

d) a rod locating member associated with the frame and having a passage for locatingly receiving a vertical blind drive rod;

e) a rod drive member having a rod connecting part adapted to be operatively joined to a rod vertical blind drive rod located by way of the rod locating member, and further having a second spur gear wheel joined to the rod connecting part, the second spur gear wheel having teeth which extend radially outwardly from a central hub; and f) the first spur gear wheel and the second spur gear wheel being in operative mesh.

The first spur gear wheel may have a smaller diameter than the second spur gear wheel.

The first spur gear wheel may have five circumferentially distributed teeth.

The second spur gear wheel may have nine circumferentially distributed teeth.

The teeth of the spur gear wheels may have substantially parallel sides and a curved free end.

The first spur gear wheel may have a rotational axis which is substantially at right angles to the rotational axis of the second spur gear wheel. However, the rotational axes of the first and second spur gear wheels may also be provided at an angle less than or more than 90°, e.g. at 75° or 105°, wherever required.

The shaft of the wand drive member may have an aperture for receiving a wand hook.

The rod connecting part of the rod drive member may include a hollow cylinder having a number of internal circumferentially distributed elongated ridges for fitting into corresponding elongated grooves of a vertical blind drive rod.

The frame may have a rear wall having a round protrusion and the second spur gear wheel has a circular recess rotatably receiving the round protrusion.

The invention also extends to a vertical blind system including a drive gear unit as set out herein.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF DRAWINGS

The invention will now be described by way of example with reference to the accompanying schematic drawings.

In the drawings there is shown in.

DESCRIPTION OF THE PREFERRED EMBODIMENTS

Figure 1:
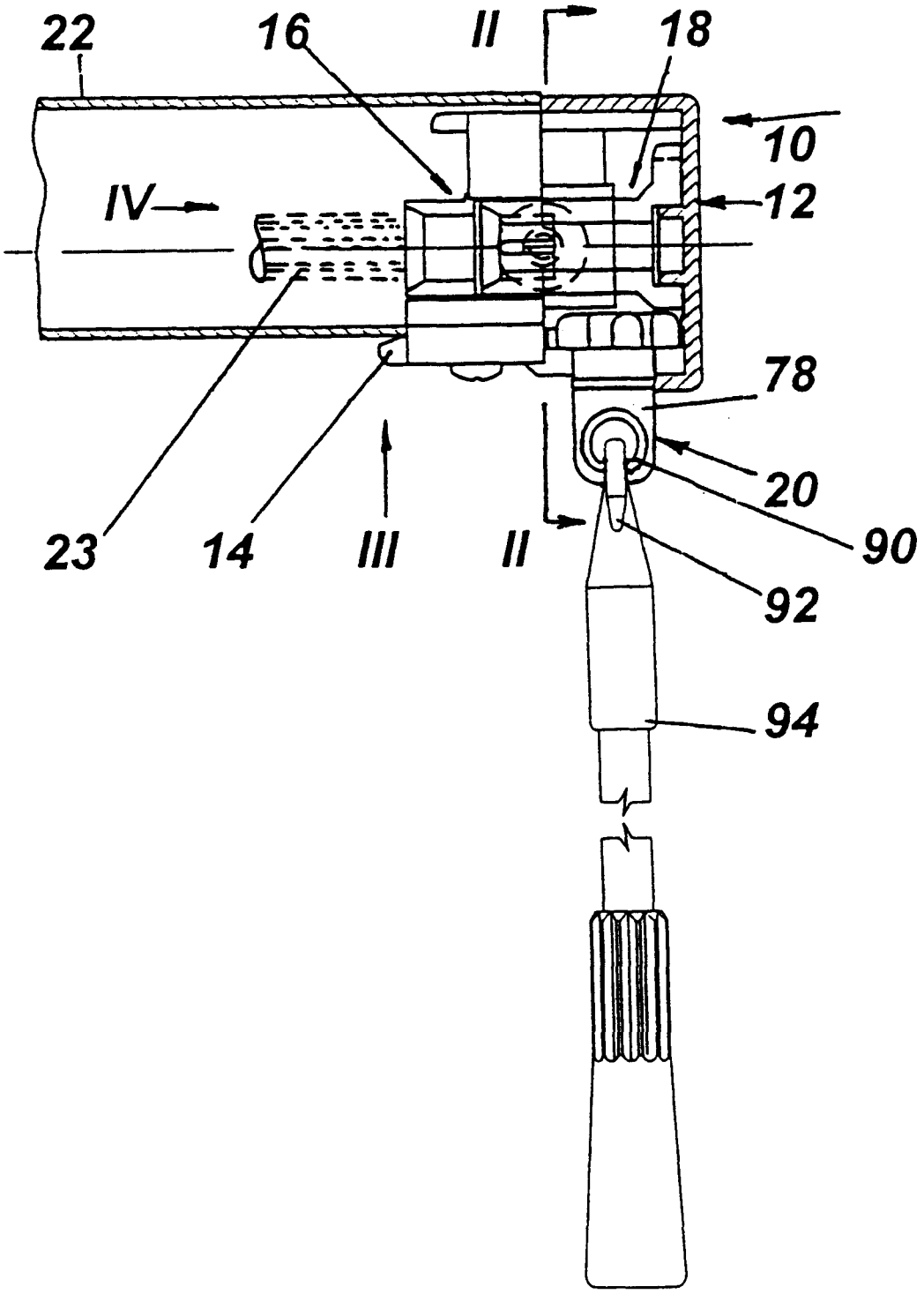
FIG. 1: a side view of a drive gear unit for tilting vanes or slats of a vertical blind system in accordance with the invention and also showing a tubular vertical blind rail fitted thereto as well as a wand.

Referring to FIG. 1 in particular, and the remaining drawings in general, the drive gear unit for tilting vanes or slats of a vertical blind system for regulating inflow of sun rays and/or light into a room or other chamber, or for preventing or hindering looking into a room or chamber in accordance with the invention, generally indicated by reference numeral 10, basically includes the following components:

1. an end cap 12
2. a rail clamping plate 14
3. a drive rod locating member 16
4. a rod driving member 18
5. a wand drive member 20

The unit 10 is shown in FIG. 1 as fitted to the end of a vertical blind tubular rail 22 and as receiving a vane or slat drive rod 23. The rod 23 is rotatable to adjust the carriages (not shown) of individual vanes or slats 20 so as to rotate these as required.

The end cap 12 and the drive rod locating member 16 together constitute a frame to which all other components of the unit 10 are operatively connected or associated with.

Figure 5:
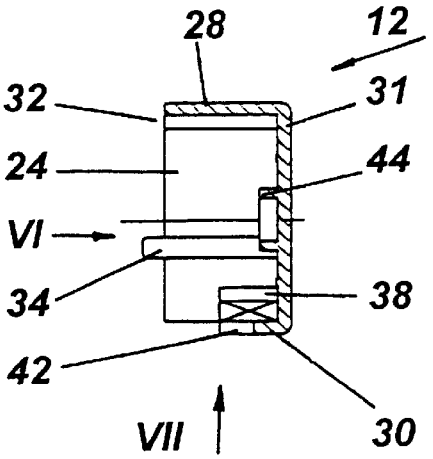
FIG. 5: a sectional side view of the end cap of the unit illustrated in FIG. 1.
Figure 6:
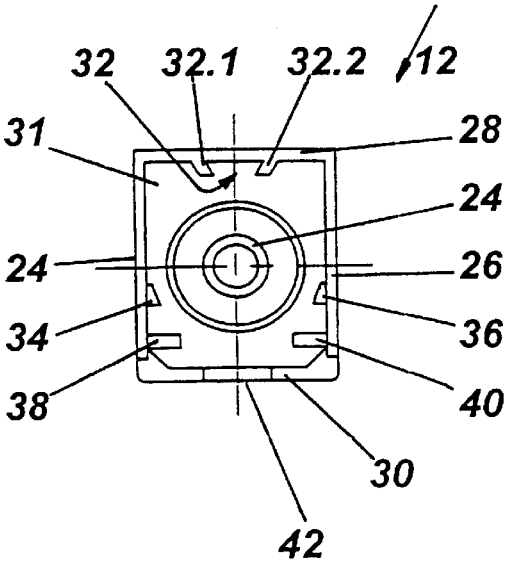
FIG. 6: a view seen along arrow VI in FIG. 5.
Figure 7:
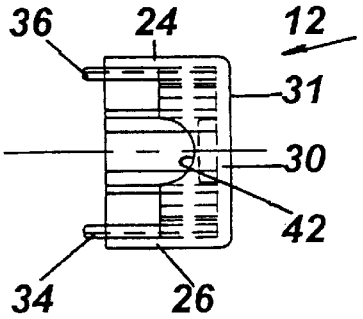
FIG. 7: a view from below seen along arrow VII in FIG. 5.

Referring to FIGS. 5 to 7 in particular, the end cap 12 has side walls 24, 26, an upper wall 28, a floor 30 and a rear wall 31.

On its inner faces the upper wall 28 have a dove tail slot 32 between two elongated ridges 32.1 , 32.2.

The side walls 24, 26 have elongated inclined opposite ridges 34, 36, and elongated opposite plates 38, 40 on their opposite inner faces respectively.

The floor 30 has a cut-out 42 and the rear wall 31 has a round circular collar or protrusion 44 on its inner face.

Figure 8:
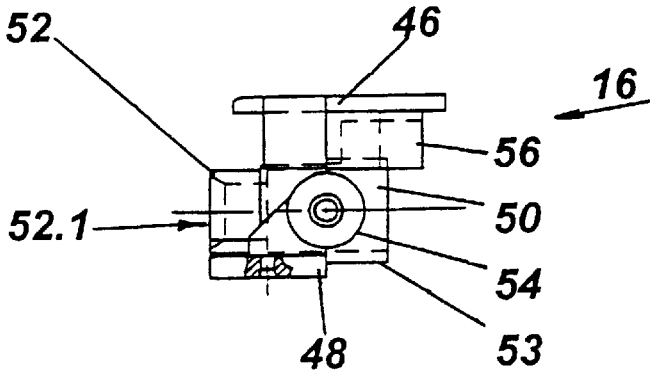
FIG. 8: a side view of a rod locating member of the unit shown in FIG. 1.

FIG. 8 shows the drive rod locating member 16 in particular. It has an upper plate 46 which fits into the dove tailed groove 32 of the end cap 12 between the ridges 32.1, 32.2.

The bottom plate 48 of the member 16 fits into the cap 12 between the ridges 38, 40 and the floor 30.

The component 16 further has a central body 50 having an elongated first cylinder 52 with a round hole 52.1 for receiving a vane or slat drive rod 23 and opposite thereto, a widened cylinder 53. The body 50 carries on its opposite sides two rotatable wheels 54 for guiding the conventional cords of a vertical blind system, which cords are not shown.

At the upper end, the body 50 has a semi-circular curved plate 56.

Figure 13:
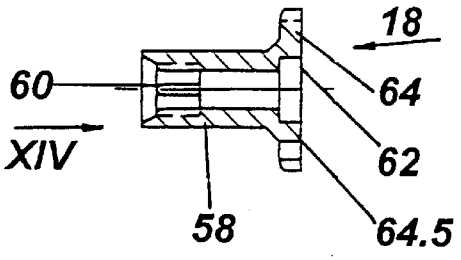
FIG. 13: a sectional side view of a rod drive member of the unit shown in FIG. 1.
Figure 14:
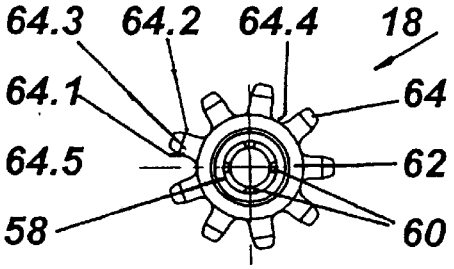
FIG. 14: an end view seen along arrow XIV in FIG. 13.

Referring also to FIGS. 13 and 14, the rod drive member 18 includes an elongated cylinder 58 having internal elongated ridges 60 at one end for locatingly receiving associated elongated grooves of the drive rod 23. At the opposite end it has a spur gear wheel 62 with gear teeth 64, which will be described further below.

The rod drive member 18 fits by way of its cylinder 58 into the widened cylinder 53 of the unit 16. Thereby the rod 23 passes through the hole 52.1 of the cylinder 52 into the cylinder 58 of the member 18.

Figure 9:
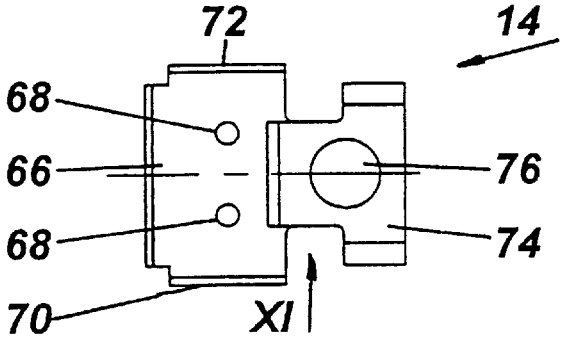
FIG. 9: a view from below of the base plate of the unit shown in Figure 1.
Figure 10:
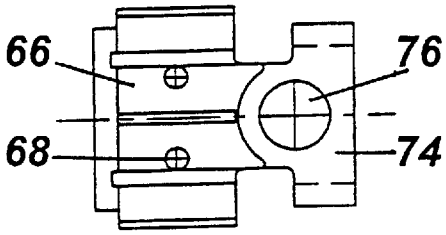
FIG. 10: a top view of the base plate opposite to the view shown in FIG. 9.
Figure 11:
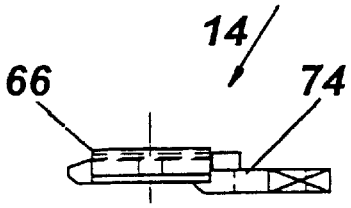
FIG. 11: a side view of the base plate seen along arrow XI in FIG. 1.

Referring to FIGS. 9 and 10, the rail clamping plate 14 has a first plate 66 having two holes 68 and elongated side ridges 70, 72 as well as a second plate 74 having a hole 76.

The rail damping plate 14 rotatably supports the wand drive member 20 (see also FIGS. 15 and 16) by allowing its shaft 78 to pass rotatably through the hole 76 so that the spur gear wheel 80, having teeth 82, can rotatably engage with the teeth 64 of the spur gear wheel 62. The collar 84 engages below the second plate 74 to keep the wand drive member 20 in operative position.

Figure 12:
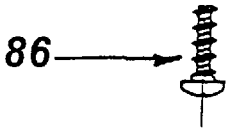
FIG. 12: a side view of a screw for connecting the base plate to the rod locating member shown in FIG. 8.

The rail clamping plate 14 is attached to the end cap 12 by means of screws 86 (FIG. 12) passing through the holes 68 for screwably fitting it to the part 18. Thereby a gap 88 (see FIG. 2) is formed between the plate 14 and the floor 30 of the cap 12 into which the rail 22 (see FIG. 1) can be fitted and clamped.

Figure 2:
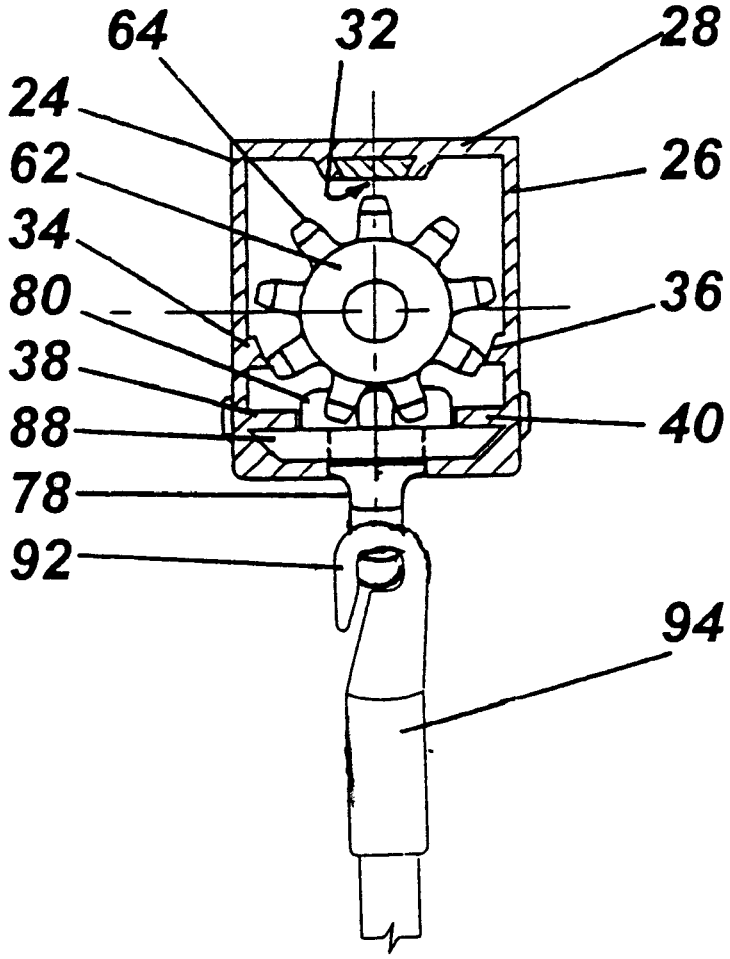
FIG. 2: a sectional end view onto the end cap of a unit illustrated in FIG. 1 and seen along arrows II—II in FIG. 1.
Figure 3:
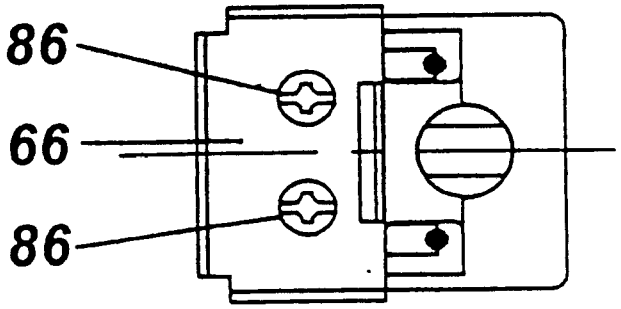
FIG. 3: a view from below seen along arrow III in FIG. 1 but without the rail and the wand.
Figure 4:
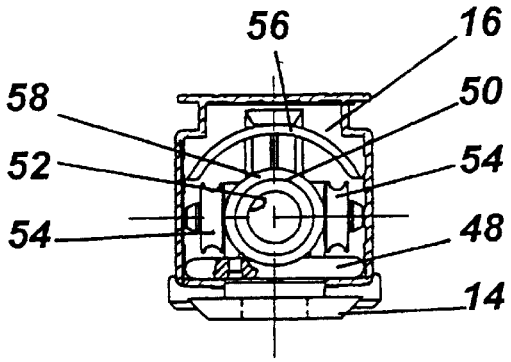
FIG. 4: view seen along arrow IV in FIG. 1 but without the rail and the wand.

As shown in FIGS. 1, 2 and 14 the shaft 78 has an aperture 90 into which a wand hook 92 of a wand 94 can be attached.

By rotating the wand 94, the wand drive member 20 is rotated so that the spur gear wheel 80 rotates the spur gear wheel 62 for rotating the rod 54 as required.

Referring to FIGS. 13 to 16 in particular, it can be seen that each of the teeth 64 of the spur gear wheel 62 has sides 64.1, 64.2 which are substantially parallel and the upper face 64.3 joining these sides is slightly curved. Between adjacent teeth 64 a fairly large gap 64.4 exists which allows ample space for receiving a meshing tooth 82 of the spur gear wheel 80 illustrated in FIGS. 15 and 16.

Figure 15:
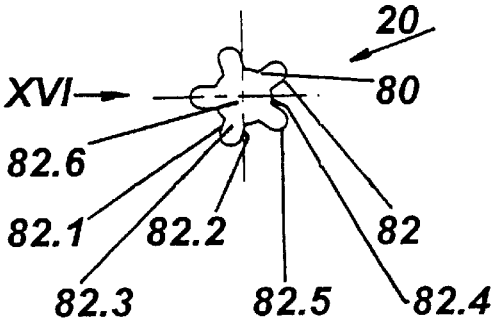
FIG. 15: a plan view of a wand drive member of the unit shown in FIG. 1.
Figure 16:
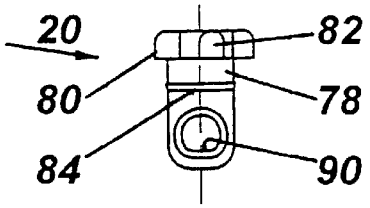
FIG. 16: a side view seen along arrow XVI in FIG. 15.

In FIGS. 15 and 16 details of the spur gear wheel 80 are given. Here the teeth 82 have sides 82.1, 82.2 which are substantially parallel and the upper face 82.3 joining these sides is slightly curved. Between adjacent teeth 82 a fairly large gap 82.4 exists which allows ample space for receiving a meshing tooth 64 of the spur gear wheel 62 illustrated in FIGS. 13 and 14. The outer face 82.5 of each tooth 82 is curved so as to facilitate movement into a gap 64.4 between meshing teeth 64 of the spur gear wheel 62.

As is shown the gear wheels 62, 80 respectively have gear teeth 64, 82 extending free standing radially outwardly from a central hub 64.5, 84.5.

As shown gear wheels 62, 80 have teeth 64, 82 which are formed separately and not on a backing disc. They therefore can almost be described as "windmill" wheels in which the vanes of a windmill are equivalent to the teeth of these gear wheels 62, 80. One advantage is that these free standing teeth 64, 82 facilitate avoidance of dirt collection between the teeth.

The formation of the meshing spur gear wheels 62 and 80 allow for a smooth drive and due to the particular design prevent any jamming.

The use of two meshing spur gear wheels 62 and 80 does not require very accurate tooling and the assembly thereof is relatively uncomplicated. Thus production and assembly costs are relatively low.

Furthermore the two meshing spur gear wheels 62, 80 can operate satisfactory under fairly dusty conditions.

All of the components, with the exception of the screws 86, are made of suitable plastics material, by way of injection moulding.

While specific embodiments of the invention have been shown and described in detail to illustrate the inventive principles, it will be understood that the invention may be embodied otherwise without departing from such principles.

I claim:

1. A drive gear unit for tilting vertically orientated slats of a vertical blind system, which includes a) a frame;

b) connection means for connecting the frame to a tubular support rail for the vertical blind system including ;a vertical blind drive rod and rotatable, vertically orientated slats;

c) a wand drive member having a shaft and a first spur gear wheel provided on the shaft and being rotatably mounted on the frame so that the shaft has an end extending out of the frame for operative connection to a wand and the first spur gear wheel being located inside the frame, the first spur gear having teeth which extend radially outwardly from a central hub;

d) a rod locating member associated with the frame and having a passage for locatingly receiving the vertical blind drive rod;

e) a rod drive member having a rod connecting part adapted to be operatively joined to the rod vertical blind drive rod locatingly received by the rod locating member, and further having a second spur gear wheel joined to the rod connecting part, the second spur gear wheel having teeth which extend radially outwardly from a central hub; and f) the first spur gear wheel and the second spur gear wheel being in operative mesh.

2. A unit as claimed in claim 1, in which the first spur gear wheel has a smaller diameter than the second spur gear wheel.

3. A unit as claimed in claim 2, in which the first spur gear wheel has five circumferentially distributed teeth.

4. A unit as claimed in claim 3, in which the second spur gear wheel has nine circumferentially distributed teeth.

5. A unit as claimed in claim 1, in which the teeth of the spur gear wheels have substantially parallel sides and a curved free end.

6. A unit as claimed in claim 1, in which the first spur gear wheel has a rotational axis which is substantially at right angles to the rotational axis of the second spur gear wheel.

7. A unit as claimed in claim 1, in which the first spur gear wheel has a rotational axis which is at about 75° to the rotational axis of the second spur gear wheel.

8. A unit as claimed in claim 1, in which the first spur gear wheel has a rotational axis which is at about 105° to the rotational axis of the second spur gear wheel.

9. A unit as claimed in claim 1, in which the shaft of the wand drive member has an aperture for receiving a wand hook.

10. A unit as claimed in claim 1, in which the rod connecting part of the rod drive member includes a hollow cylinder having a number of internal circumferentially distributed elongated ridges for fitting into corresponding elongated grooves of the vertical blind drive rod.

11. A unit as claimed in claim 1, in which the frame has a rear wall having a round protrusion and the second spur gear wheel has a circular recess rotatably receiving the round protrusion.

* * * * *